US011490712B2

(12) United States Patent
Prade

(10) Patent No.: US 11,490,712 B2
(45) Date of Patent: Nov. 8, 2022

(54) COSMETIC APPLICATOR

(71) Applicant: L'OREAL, Paris (FR)

(72) Inventor: Pauline Prade, Paris (FR)

(73) Assignee: L'OREAL, Paris (FR)

( * ) Notice: Subject to any disclaimer, the term of this patent is extended or adjusted under 35 U.S.C. 154(b) by 579 days.

(21) Appl. No.: 15/576,911

(22) PCT Filed: May 30, 2016

(86) PCT No.: PCT/EP2016/062173
§ 371 (c)(1),
(2) Date: Nov. 27, 2017

(87) PCT Pub. No.: WO2016/189168
PCT Pub. Date: Dec. 1, 2016

(65) Prior Publication Data

US 2018/0146767 A1 May 31, 2018

(30) Foreign Application Priority Data

May 28, 2015 (FR) ..... 1554793

(51) Int. Cl.
*A45D 40/26* (2006.01)

(52) U.S. Cl.
CPC .... *A45D 40/262* (2013.01); *A45D 2200/1072* (2013.01)

(58) Field of Classification Search
CPC ..... A45D 2034/005; A45D 2034/007; A45D 34/042; A45D 40/26; A45D 40/261; A45D 40/262; A45D 2200/1072; A46B 9/021
USPC ..... 401/126, 129, 130; 132/320
See application file for complete search history.

(56) References Cited

U.S. PATENT DOCUMENTS

| | | | | |
|---|---|---|---|---|
| 5,888,005 | A * | 3/1999 | Gueret | A45D 34/046 401/119 |
| 2007/0020027 | A1* | 1/2007 | Gueret | A45D 40/262 401/130 |
| 2007/0181143 | A1* | 8/2007 | Montoli | A45D 34/04 132/320 |
| 2008/0017209 | A1* | 1/2008 | Gueret | A45D 34/04 132/73 |

(Continued)

FOREIGN PATENT DOCUMENTS

| | | |
|---|---|---|
| EP | 1 336 353 A1 | 8/2003 |
| EP | 1 842 448 A2 | 10/2007 |

(Continued)

OTHER PUBLICATIONS

English Translation of International Search Report for PCT/EP2016/062173 dated Aug. 2, 2016 (2 pages).

*Primary Examiner* — Rachel R Steitz
(74) *Attorney, Agent, or Firm* — Shumaker, Loop & Kendrick, LLP

(57) ABSTRACT

A device for packaging and applying eyeliner including a container containing the eyeliner to be applied, and an applicator tip defining an application surface for applying the eyeliner contained in the container, having at least one cavity opening on the application surface and being elongate along a longitudinal axis, the cavity being bordered laterally by two walls, the free edges of which, on the application surface side, are convex in shape about an axis perpendicular to the longitudinal axis of the cavity.

16 Claims, 4 Drawing Sheets

(56) References Cited

U.S. PATENT DOCUMENTS

| | | | | |
|---|---|---|---|---|
| 2012/0204899 | A1* | 8/2012 | Uehara | A45D 34/045<br>132/320 |
| 2014/0064822 | A1 | 3/2014 | Tani | |

FOREIGN PATENT DOCUMENTS

| | | | |
|---|---|---|---|
| FR | 2 971 923 | A1 | 8/2012 |
| FR | 2 979 207 | A1 | 8/2012 |
| WO | 2012117322 | A1 | 9/2012 |

* cited by examiner

COSMETIC APPLICATOR

TECHNICAL FIELD AND BACKGROUND

The present invention relates to devices for packaging and applying eyeliner.

It is known practice to make up the eyelid or the eyebrows by drawing a line of eyeliner with the aid of an applicator provided to this end.

Among known eyeliner applicators, some comprise a container provided with a threaded neck on which there can be fixed a closure cap which carries a stem provided at its end with an applicator tip that is generally produced by injection-molding thermoplastic material, and with a flocked coating. A wiping member is usually positioned in the neck in order to wipe off the stem and reduce the quantity of product taken when the applicator is withdrawn.

The application EP 1 336 353 describes an eyeliner applicator having a stem and an applicator end piece carried by the stem, comprising at least two applicator tips for drawing lines of different thicknesses.

The application FR 2 979 207 discloses an eyeliner applicator, the application surface of which is not flat.

SUMMARY

There is an interest in allowing the user to draw a particular line of eyeliner on the eyelids, notable a double line and/or a line that splits along the eyelid during application.

The invention aims to meet this need and achieves this by proposing a device for packaging and applying eyeliner, comprising:

a container containing the eyeliner to be applied, an applicator tip defining an application surface for applying the eyeliner contained in the container, having at least one cavity that opens onto the application surface and has an elongate shape along a longitudinal axis, the cavity being bordered laterally by two walls, the free edges of which on the application surface side have a convex shape about an axis perpendicular to the longitudinal axis of the cavity.

The region of the application surface of the applicator tip, having the cavity, is advantageously domed toward the outside. Preferably, the cavity opens onto an application surface that is domed toward the outside.

By virtue of the presence of the cavity, the user can easily draw a line that splits during application. The user can start by bringing the domed portion of the applicator tip, extending outside the cavity, into contact with the eyelid in order to draw a solid line. The user can move the tip over the skin, changing the inclination of the tip relative to the skin, in order to bring the two abovementioned walls, situated on either side of the cavity, into contact with the skin. This allows the line to split. It is thus possible to draw, for example, a single line on the inside of the eye, said line splitting in a regular and equidistant manner along the rest of the eyelid.

The cavity may or may not be a through-cavity.

The cavity may extend along only a part of the length of the region of the application surface onto which it opens. In a variant, the cavity extends along the entire length of the region of the application surface onto which it opens.

Preferably, the longitudinal axis of the cavity is different than the longitudinal axis of the body and/or of the applicator tip.

The cavity may extend along a longitudinal axis parallel to the longitudinal axis of the applicator tip. In a variant, the cavity extends along a longitudinal axis that is not parallel, notably perpendicular, to the longitudinal axis of the applicator tip.

When the cavity is not a through-cavity, its axis may be substantially parallel to, or even coincident with, the longitudinal axis of the applicator tip. When the cavity is a through-cavity, its axis may be not parallel to the longitudinal axis of the applicator tip. In particular the axis of the cavity may be transverse to the longitudinal axis of the applicator tip, being for example perpendicular thereto.

The applicator tip may have at least two lateral facets that are situated on either side of a facet having the cavity, these different facets being delimited by edges.

The cavity may open onto a region situated at the distal end of the applicator tip.

It is possible for the applicator tip only to have surfaces that are convex toward the outside, in the region of the applicator part that comes into contact with the skin during makeup application.

The applicator tip may have the overall shape of a ball.

The cavity may open onto a region of the application surface of variable or constant width, measured perpendicularly to the longitudinal axis of the applicator tip.

The width of the cavity, measured at its top perpendicularly to its longitudinal axis, is preferably variable, this width increasing from one of its ends in the direction of its other end, passing through a maximum, for example about halfway along its length, and then decreasing toward the other end.

In the case in which the cavity has an elongate shape along a longitudinal axis substantially parallel to the longitudinal axis of the applicator tip, the width of the cavity may increase in the direction of the distal end of the applicator tip, pass through a maximum, and then decrease from this maximum toward the distal end. The cavity may thus have a droplet shape.

In one variant, the width of the cavity decreases continuously in the direction of the distal end of the applicator tip. The cavity may notably have a triangular shape in this case.

In another variant, the width of the cavity is constant.

The cavity may be defined by two oblique faces that diverge toward the outside and meet at the bottom of the cavity.

The width of the cavity may be between 1 mm and 6 mm, better still between 2 mm and 4 mm. The greatest transverse dimension of the cavity may be between 1 mm and 10 mm, better still between 3 mm and 6 mm.

The length of the cavity, measured between its ends along its longitudinal axis, may be between 1 mm and 10 mm, better still between 3 mm and 6 mm.

The depth of the cavity, measured between its bottom and its top, perpendicularly to its longitudinal axis, may be between 1 mm and 10 mm, better still between 3 mm and 6 mm.

The cavity may open onto a region that has a radius of curvature greater than 1 mm, better still greater than 10 mm, in longitudinal section.

The applicator tip may be symmetrical with respect to a first median plane of symmetry that passes through the longitudinal axis of the cavity.

The applicator tip may be symmetrical with respect to a second plane of symmetry that intersects the cavity transversely, halfway along its length.

A symmetrical shape of the applicator tip makes it possible to make up the right eye or the left eye in an identical manner.

The applicator tip is preferably made of felt, that is to say it comprises fibers that are oriented longitudinally and bonded together. The product may thus diffuse within the applicator tip by capillary action, on account of its porosity, and the applicator tip may be permanently fixed to a container containing the eyeliner.

The fibers may be fibers made of thermoplastic material, notably made of acrylic polymer, polyester or polyamide. The fibers may have a linear density of less than 1 denier, preferably between 0.5 and 0.9 denier, in particular 0.7 denier (or around 9 micrometers). The fibers may be made of Nylon®.

The cavity may be produced by machining, notably milling, or punching a blank.

Outside the cavity, it is possible for the applicator tip not to have any perforations or indentations in its surface used for application. It is thus possible for the applicator tip not to have any outwardly concave edge at its end, or any striations or grooves.

The applicator tip may have a narrowing of its cross section between an applicator part defining the application surface and an end piece for mounting the applicator tip in the body of an applicator pen or in a stem of an applicator.

The distal end of the applicator tip is preferably situated on the longitudinal axis of the applicator tip, said longitudinal axis being, preferably likewise, rectilinear.

A further subject of the invention is a method for making up the eyelid, comprising the step of applying, with the aid of a device according to the invention, a line of eyeliner that splits along the eyelid, during application. In particular, the line may be a single line toward the inner corner of the eye, toward the nose, and split toward the outside.

BRIEF DESCRIPTION OF THE DRAWINGS

Further features and advantages of the present invention will become apparent from reading the following detailed description of nonlimiting illustrative embodiments thereof and from examining the appended drawing, in which.

DETAILED DESCRIPTION

Figure 1:
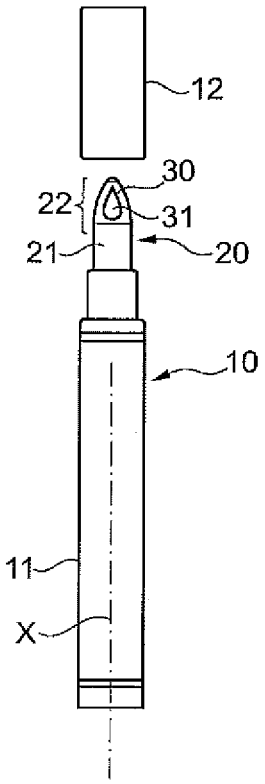
FIG. 1 shows a schematic elevation view of an example of a packaging and application device according to the invention, in the form of an applicator pen.

The packaging and application device 10 shown in FIG. 1 is in the form of an applicator pen comprising a body 11 with an elongate shape along an axis X, which defines a reservoir containing the makeup product to be applied, in this case eyeliner. The latter contains for example water, one or more pigments, notably iron oxide, and/or one or more colorants, and polymers.

The capacity of the reservoir is for example between 1 and 15 ml.

The device 10 may also comprise, as illustrated, a closure cap 12 which is fixed on the body 11 for example by snap-fastening, screwing or friction.

The body 11 bears an applicator tip 20 according to the invention, shown on its own in FIGS. 2 to 16, which may be fixed to the body 11 by any suitable means and which is for example force-fitted into a corresponding housing provided at the upper end of the body 11, communicating with the reservoir.

This tip 20 is preferably made of felt.

The tip 20 has a mounting end piece 21 which serves to fix it in the body 11, and an applicator part 22 which serves for application by coming into contact with the skin in order to deposit thereon eyeliner which impregnates the felt.

Figure 9:
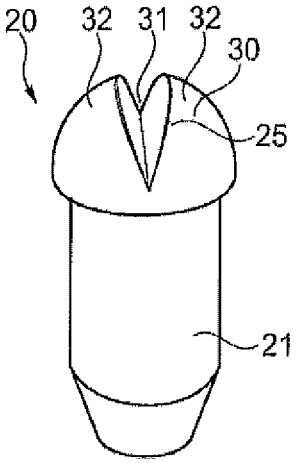
FIG. 9 shows a variant applicator tip according to the invention, shown on its own and in perspective.
Figure 13:
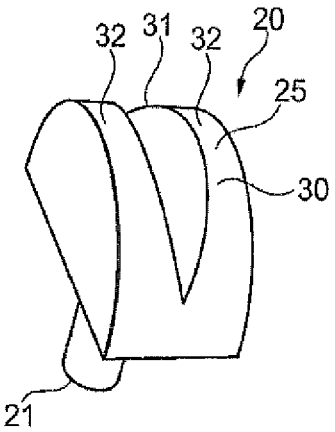
FIG. 13 shows a variant applicator tip according to the invention, shown on its own and in perspective.
Figure 10:
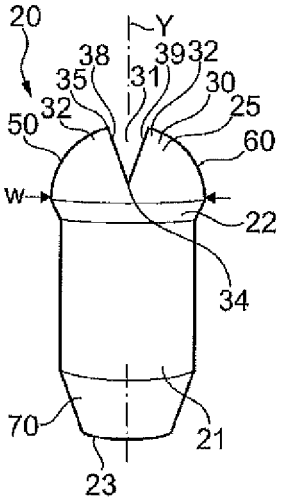
FIG. 10 is a front view of the applicator tip from FIG. 9.
Figure 11:
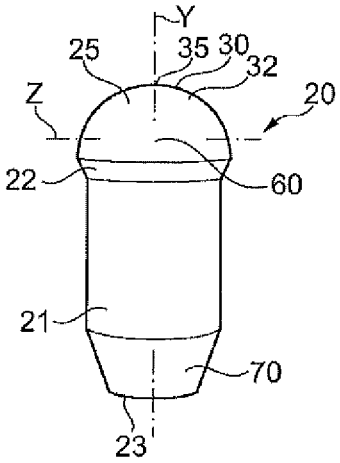
FIG. 11 is a side view of the applicator tip from FIG. 9.
Figure 12:
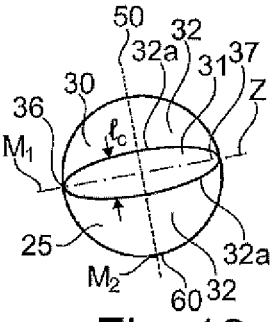
FIG. 12 is a top view of the applicator tip from FIG. 9.
Figure 15:
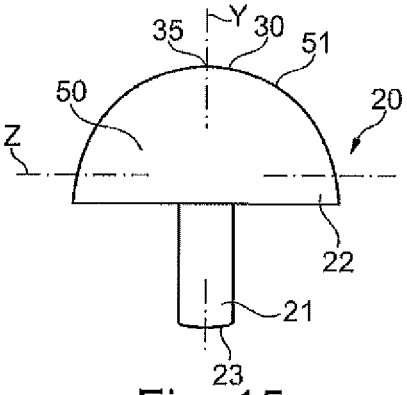
FIG. 15 is a side view of the applicator tip from FIG. 13.
Figure 14:
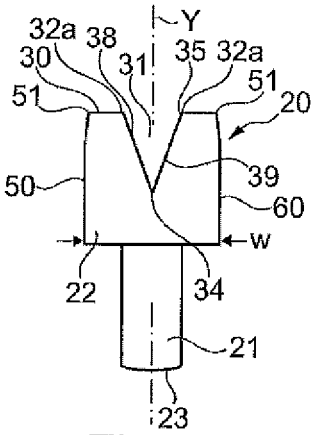
FIG. 14 is a front view of the applicator tip from FIG. 13.
Figure 16:
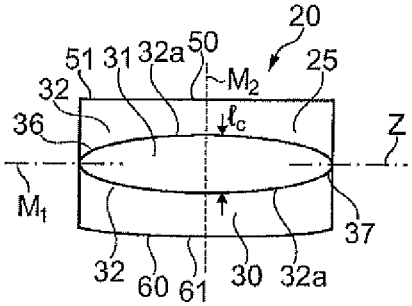
FIG. 16 is a top view of the applicator tip from FIG. 13.

The end piece 21 may have a chamfered proximal part 70, as can be seen in FIGS. 9 to 11.

The applicator tip 20 extends along a longitudinal axis Y which, in the examples described, is coincident with the longitudinal axis X of the body 11 of the device 10.

The applicator tip 20 is fed with product through its proximal end 23 and the product can diffuse longitudinally therein, along the axis Y, until it reaches the applicator part 22 intended to come into contact with the skin.

The end piece 21 has a rotationally symmetrical shape about the axis Y, with a circular section. The largest diameter of the end piece 21 is for example between 4 and 6 mm and is for example 5 mm.

The applicator part 22 defines an application surface 25 having a cavity 31 of elongate shape along a longitudinal axis Z. As can be seen notably in FIG. 4, the cavity 31 is bordered laterally by two walls 32, the free edges 32*a* of which have a convex shape about an axis T perpendicular to the longitudinal axis Z of the cavity 31.

Preferably, the region 30 of the application surface 25 onto which the cavity 31 opens is domed toward the outside.

In the example in FIGS. 2 to 5, the cavity 31 is a through-cavity that opens onto the region 40 of the application surface 25 away from the abovementioned region 30.

Figure 8:
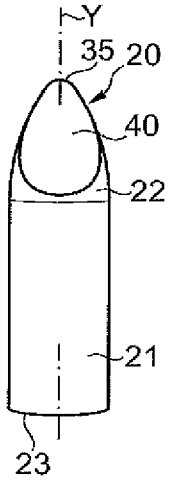
FIG. 8 is a rear view of the applicator tip from FIG. 6.
Figure 7:
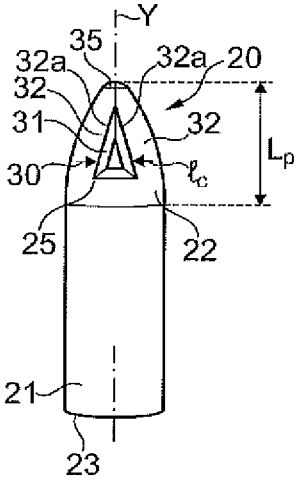
FIG. 7 is a front view of the applicator tip from FIG. 6.
Figure 2:
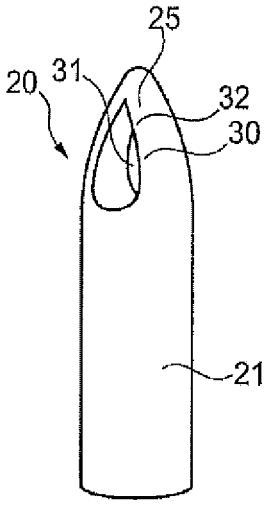
FIG. 2 shows a perspective view of the applicator tip of the pen from FIG. 1 on its own.
Figure 6:
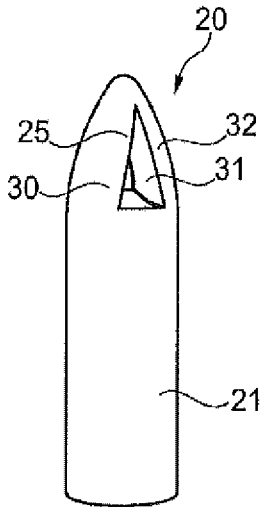
FIG. 6 shows a variant applicator tip according to the invention, shown on its own and in perspective.

In a variant illustrated in FIGS. 6 to 8, the cavity 31 is not a through-cavity.

In the two examples in FIGS. 2 to 8, the longitudinal axis Z of the cavity 31 is coplanar with the longitudinal axis Y of the applicator tip 20, notably substantially parallel.

In these examples, the cavity 31 extends along only a part of the length $L_p$ of the region 30 of the application surface 25 onto which it opens.

In the examples in FIGS. 2 to 8, the region 40 away from the region 30 having the cavity 31 is concave about the same axis T, these two regions 30, 40 being, in the example described, connected on each side by two lateral regions 50, 60 that are convex toward the outside.

Figure 3:
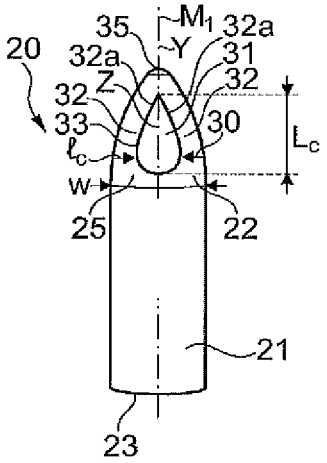
FIG. 3 is a front view of the applicator tip from FIG. 2.
Figure 4:
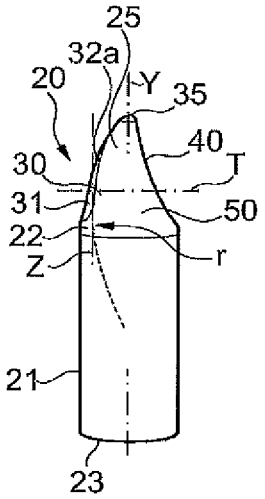
FIG. 4 is a side view of the applicator tip from FIG. 2.

As shown notably in FIGS. 3 and 7, the width $l_c$ of the cavity 31, measured at its top 33, perpendicularly to its longitudinal axis Z, may be variable.

In the example in FIGS. 2 to 5, the width $l_c$ of the cavity 31 increases in the direction of the distal end 35 of the applicator tip 20, passing through a maximum situated, in this example, at a distance from the proximal end of the cavity 31 of less than a quarter of the length $L_c$ of the cavity 31, and then decreases from this maximum toward the distal end 35 of the applicator tip 20. The cavity 31 thus has a droplet shape, as can be seen notably in FIG. 3.

In the variant shown in FIGS. 6 to 8, the width $l_c$ of the cavity 31 decreases continuously in the direction of the distal end 35 of the applicator tip 20. In this example, the cavity 31 has a triangular shape.

In the examples in FIGS. 2 to 8, the region 30 having the cavity 31 has a variable width, narrowing continuously in the direction of the distal end 35 of the applicator tip 20.

In the variants represented by the two examples in FIGS. 9 to 16, the longitudinal axis Z of the cavity 31 is perpendicular to the longitudinal axis Y of the applicator tip 20.

In the examples in FIGS. 9 to 16, the, variable, width $l_c$ of the cavity 31 increases from one of its ends 36 in the direction of its other end 37, passing through a maximum, situated halfway along its length, and then decreases toward this other end 37.

In these two examples, the cavity 31 is defined by two oblique faces 38, 39 that diverge toward the outside and meet at the bottom 34 of the cavity.

In the example in FIGS. 9 to 12, the applicator tip 20 has the overall shape of a ball, the application surface 25 being convex toward the outside.

In the variant in FIGS. 13 to 16, the applicator part 22 has two flat lateral facets 50, 60 that are situated on either side of the facet 30 onto which the cavity 31 opens, these different facets being delimited by edges 50, 61. In this example, the facet 30 has a constant width.

Figure 5:
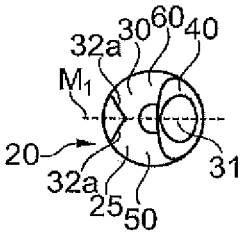
FIG. 5 is a top view of the applicator tip from FIG. 2.

Generally, the applicator part 22 is, preferably, as can be seen notably in FIGS. 3 and 5, symmetrical with respect to a first median plane $M_1$ passing through the longitudinal axis Z of the cavity 31.

In the examples in FIGS. 9 to 16, the applicator part 22 is likewise symmetrical with respect to a second median plane $M_2$, perpendicular to the first plane $M_1$, intersecting the cavity 31 transversely, halfway along its length.

Generally, the length $L_p$ of the applicator part 22 is for example between 2 and 10 mm, better still between 3 and 7 mm. The greatest transverse dimension w of the applicator part 22 is for example between 2 and 10 mm, better still between 3 and 6 mm.

The applicator part 22 may, as illustrated in FIGS. 9 to 12, have a narrowing where it is joined to the end piece 21.

The applicator tip is not necessarily fixed to a container body during application.

Figure 17:
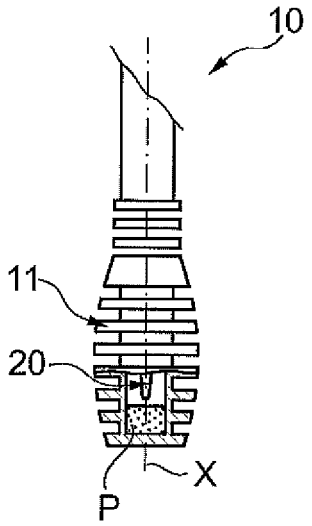
FIG. 17 shows a variant packaging and application device.

It may be mounted, as illustrated in FIG. 17, at the end of a stem of an applicator which can be fixed to the body 11 of a container containing the product P.

Figure 18:
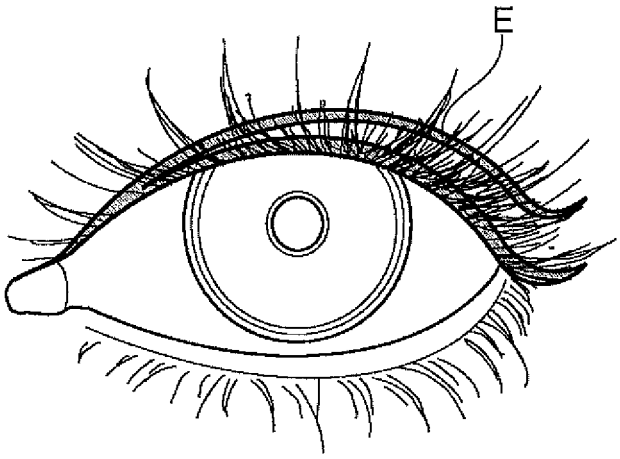
FIG. 18 illustrates an example of the makeup result that can be obtained with the invention.

During use, the user can draw, during application, as illustrated in FIG. 18, a line E of eyeliner that splits along the eyelid, by choosing to apply the product with a surface interrupted by the cavity 31 or with a wider surface, away from the cavity. The choice of surface used for application is made by orienting and inclining the tip in a suitable manner relative to the skin.

The invention is not limited to the examples that have just been described. Notably, it is possible to further modify the shape of the applicator tip without departing from the scope of the present invention. The applicator tip can be produced by molding an elastomer, and then covering it with a flocked coating.

The expression "comprising a" should be understood as being synonymous with "comprising at least one".

The invention claimed is:

1. A device for packaging and applying eyeliner, comprising:

a container containing the eyeliner to be applied, and an applicator tip defining an application surface including a first region for applying the eyeliner contained in the container, the first region of said application surface having at least one cavity that opens onto the application surface, the cavity having an elongate shape extending along a longitudinal axis of the cavity, the cavity being bordered laterally by two walls having free edges on the application surface side which have a convex shape about an axis perpendicular to the longitudinal axis of the cavity, the first region of the application surface having the cavity being domed relative to a longitudinal axis of the applicator tip, a second region away from the first region having the cavity being concave about the axis perpendicular to the longitudinal axis of the cavity, these two regions being connected on each side by two lateral regions that are each domed relative to the longitudinal axis of the applicator tip.

2. The device as claimed in claim 1, wherein the cavity is not a through-cavity.

3. The device as claimed in claim 1, wherein the cavity is a through-cavity.

4. The device as claimed in claim 1, wherein the cavity extends along only a part of the length of the first region of the application surface onto which it opens.

5. The device as claimed in claim 1, wherein the cavity extends along an entire length of the first region of the application surface onto which it opens.

6. The device as claimed in claim 1, wherein the longitudinal axis of the cavity is parallel to the longitudinal axis along which the applicator tip extends.

7. The device as claimed in claim 1, wherein the first region of the application surface onto which the cavity opens is of variable width.

8. The device as claimed in claim 1, wherein the cavity has a width, measured at its top perpendicularly to its longitudinal axis, which is variable, increasing notably from one of its ends in the direction of its other end, passing through a maximum, and then decreasing toward the other end.

9. The device as claimed in claim 1, wherein the applicator tip is symmetrical with respect to a first median plane of symmetry that passes through the longitudinal axis of the cavity.

10. The device as claimed in claim 1, wherein the applicator tip is made of felt.

11. A method for making up the eyelid, comprising the step of applying, with the aid of a device as defined in claim 1, a line of eyeliner that splits along the eyelid, during application.

12. A device for packaging and applying eyeliner, comprising:

a container containing the eyeliner to be applied, and an applicator tip defining an application surface for applying the eyeliner contained in the container, a first region of said application surface having at least one cavity that opens onto the application surface, the cavity having an elongate shape extending along a longitudinal axis of the cavity, the cavity being bordered laterally by two walls having free edges, the free edges on a side of the application surface have a convex shape about an axis perpendicular to the longitudinal axis of the cavity, the cavity opening onto an application surface that is domed relative to a longitudinal axis of the applicator tip, the longitudinal axis of the cavity being perpendicular to the longitudinal axis along which the applicator tip extends.

13. The device as claimed in claim 12, wherein the applicator tip has at least two lateral facets that are situated on either side of a facet having the cavity, these different facets being delimited by edges.

14. The device as claimed in claim 12, wherein the cavity has a bottom and is defined by two oblique faces that diverge toward the outside of the applicator and meet at said bottom of the cavity.

15. The device as claimed in claim 12, wherein the applicator tip is symmetrical with respect to a second plane of symmetry that intersects the cavity transversely, halfway along its length.

16. The device as claimed in claim 12, wherein the first region of the application surface onto which the cavity opens is of constant width.

* * * * *